US006696780B1

(12) United States Patent
Ohmae et al.

(10) Patent No.: US 6,696,780 B1
(45) Date of Patent: Feb. 24, 2004

(54) ELECTRON GUN COMPRISING A TUBULAR ELECTRODE HAVING A COILED PORTION FORMED THEREIN

(75) Inventors: Hideharu Ohmae, Toyonaka (JP); Masahiko Konda, Ibaraki (JP); Toshiharu Hoshi, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/469,029

(22) Filed: Dec. 21, 1999

(30) Foreign Application Priority Data

Dec. 21, 1998 (JP) ..... 10-362624

(51) Int. Cl.[7] ..... H01J 29/46
(52) U.S. Cl. ..... 313/449; 313/427; 313/453
(58) Field of Search ..... 313/410, 411, 313/414, 416, 426, 427, 444, 449, 450, 453, 479

(56) References Cited

U.S. PATENT DOCUMENTS 3,564,319 A * 2/1971 Starr ..... 313/453
3,610,992 A * 10/1971 Miyaoka ..... 313/449
3,748,514 A * 7/1973 Standaart ..... 313/410
4,713,879 A * 12/1987 Vrijssen ..... 313/450 X
5,521,464 A * 5/1996 Vrijssen et al. ..... 313/450

FOREIGN PATENT DOCUMENTS

| | | | |
|---|---|---|---|
| JP | 53-96622 | 8/1978 | ..... H01J/31/38 |
| JP | A-8-115684 | 5/1996 | |
| JP | A-10-074465 | 3/1998 | |
| JP | 10-172464 | 6/1998 | ..... H01J/29/50 |

OTHER PUBLICATIONS

Patent Abstracts of Japan; Publication No. 10074465 A; date of publication: Mar. 17, 1998; 1 page.
Patent Abstracts of Japan; Publication No. 08115684 A; date of publication: May 7, 1996; 1 page.
Patent Abstracts of Japan, publication No. 10172464A, published on Jun. 26, 1998 (1 page).
Japanese Office Action for application No. H10–362624, dated Jun. 24, 2003 (3 pages).

* cited by examiner

*Primary Examiner*—Vip Patel
*Assistant Examiner*—Joseph Williams
(74) *Attorney, Agent, or Firm*—Rosenthal & Osha LLP

(57) ABSTRACT

An electron gun that can provide a desired electron beam modulation effect without preventing a modulation magnetic field from passing from an exterior of the vacuum portion is provided. A part of a tubular G3 electrode in an electron gun is formed into a coiled portion to allow the modulation magnetic field to pass through the clearances between parts of a wire composing the coiled portion.

7 Claims, 6 Drawing Sheets

ELECTRON GUN COMPRISING A TUBULAR ELECTRODE HAVING A COILED PORTION FORMED THEREIN

FIELD OF THE INVENTION

This invention relates to an electron gun for a cathode ray tube. More specifically, this invention relates to a technique to improve high frequency magnetic field transmission property of an electron gun.

BACKGROUND OF THE INVENTION

FIG. 5 shows a structure of a conventional electron gun for a projection-type monochrome cathode ray tube disclosed in Unexamined Published Japanese Patent Application (Tokkai-Hei) 10-74465. In FIG. 5, 14 denotes a neck tube having an electron gun disposed inside the tube. The electron gun is formed by sequentially arranging a cup-shaped G1 electrode (control electrode) 5 housing a cathode 6, a cup-shaped G2 electrode (acceleration electrode) 7, a tubular G3 electrode (pre-anodic electrode) 8, a G4 electrode (focusing electrode) 9, and a G5 electrode (anodic electrode) 10 enveloping the top end part of the G4 electrode 9. A main electron lens is formed between the G3 electrode 8 and the G4 electrode 9. Another electron lens is formed inside the G5 electrode 10 at a position between the G4 electrode 9 and the G5 electrode 10. Outside of the neck tube 14, a velocity modulation coil 18, a convergence yoke 15, and a deflection yoke 16 are disposed.

As shown in FIG. 5, the state-of-the-art for improving focusing performance is subjecting the electron gun disposed inside the neck tube 14 to magnetic field modulation caused by the velocity modulation coil 18 from outside of the neck tube 14 in order to carry out velocity modulation of an electron beam. Namely, a track of an electron beam outgoing from a cathode 6 is modulated by an alternating magnetic field generated by the deflection yoke 16, the convergence yoke 15, the velocity modulation coil 18 and the like, before the electron beam reaches a phosphorous screen surface. The deflection yoke 16, which is attached to a funnel cone portion of the cathode ray tube, generates an alternating magnetic field 17 to deflect an electron beam track, so that the electron beam scans the phosphorous screen surface of the cathode ray tube. The convergence yoke 15, attached to the outside of the neck tube 14 of the cathode ray tube, corrects raster distortion and color displacement by generating an alternating magnetic field 20 to modulate the electron beam track. The velocity modulation coil 18 is attached to the outside of the neck tube 14 of the cathode ray tube and generates alternating magnetic field 19 to modulate the scanning speed of the electron beam in order to prevent a high-intensity part on the phosphorous screen from extending to a low-intensity part and to sharpen images.

The frequency of an alternating magnetic field for modulating an electron beam reaches a mega-Hertz order equivalent to a frequency for images. Therefore, when an electron gun includes metal portions formed by deep-drawing metal materials such as stainless steel, the alternating magnetic field is damped and a desired electrode beam modulation cannot be obtained.

As shown in FIG. 5, most of the alternating magnetic field 20 generated by the convergence yoke 15 passes the G5 electrode 10. The deflection yoke 16 is attached to the funnel cone portion. A portion of the alternating magnetic field 17 generated by the deflection yoke 16 passes the G5 electrode 10. The velocity modulation coil 18 is disposed between the G3 electrode 8 and the G4 electrode 9. Most of the alternating magnetic field 19 generated by the velocity modulation coil 18 passes the G3 electrode 8 and the G4 electrode 9.

When an alternating magnetic field is applied through these metal electrodes, eddy current is generated at the metal electrode. The eddy current loss is increased as the frequency of the alternating magnetic field becomes high. Thus, modulation effect of the electron beam track due to the magnetic field in the high frequency modulation band is reduced. For example, eddy current is generated at the G5 electrode 10 due to the alternating magnetic field 20 generated by the convergence yoke 15. This decreases the electron beam track modulation effect provided by the convergence yoke 15.

Furthermore, this eddy current loss can heat the electrodes and break the neck tube. If the source of the alternating magnetic field and the metal electrodes of the electron gun are positioned fully apart in order to prevent the loss of the alternating magnetic field or the electrode heat, the electron beam focusing lens is arranged inevitably separated from the phosphorous screen surface. As a result, the electron beam magnification becomes high and the resolution is lowered. Especially for image display apparatuses having high deflection frequencies and wide signal bands such as high definition television, the loss in the alternating magnetic field is increased. This increased loss causes problems in use.

Tokkai-Hei 8-115684 discloses the improvement of transmission property of the magnetic field by dividing the deep-drawn metal portions into several sections and providing clearances between the respective sections. However, this method causes problems such as deterioration in assembly accuracy or increased cost. Moreover, in order to maintain the mechanical strength, the divided sections cannot be made too small and thus, the magnetic field transmission property cannot be improved remarkably.

SUMMARY OF THE INVENTION

It is an object of one or more embodiments of this invention to solve these problems and provide a cathode ray tube having an electron gun that can provide a desired electron beam modulation effect without interrupting transmission of the modulation magnetic field from the exterior of the vacuum portion.

An electron gun in accordance with an embodiment of the present invention includes a tubular electrode for an electron beam to pass through the inside and at least one part of the tubular portion of the electrode is formed into a coiled portion. Accordingly, a modulation magnetic field passes through the clearances between parts of the coiled portion and thus, eddy current loss can be decreased.

Preferably in one or more embodiments of the electron gun, at least one part of the pre-anodic electrode (G3 electrode) is formed into a coiled portion, so that an equipotential space can be formed inside the pre-anodic electrode.

Preferably, in one or more embodiments, the coiled portion is composed of a nonmetal material, so that the transmission effect of the modulation magnetic field is further improved.

In an embodiment the electron gun, the coiled portion may be a coiled wire.

Preferably, in one or more embodiments, the coiled portion is formed so that clearances between the parts adjacent to each other in the axial direction are not more than 2.5 mm. Accordingly, influences from the outer electric field can be reduced. Furthermore, the coiled portion may be formed so that the parts adjacent in the axial direction are contacted with each other. Accordingly, the strength of the electrode members can be improved while maintaining the effect of transmission of the modulation magnetic field.

A manufacturing method in accordance with an embodiment of the present invention is applied to provide an electron gun having a tubular electrode for passing an electron beam inside the electrode, in which at least one part of the tubular portion of the electrode is formed into a coiled portion. In the method, a coiled portion is formed by cutting spirally a tubular electrode member and then stretching the electrode member in the axial direction. According to the method, the coiled portion can easily be manufactured.

A cathode ray tube device in accordance with an embodiment of the present invention includes a cathode ray tube having an electron gun inside the neck portion, and a velocity modulation coil outside the cathode ray tube. At least one part of a pre-anodic electrode of the electron gun is formed into a coiled portion, and the velocity modulation coil is provided around the coiled portion of the pre-anodic electrode. Accordingly, velocity modulation effect can be improved.

DETAILED DESCRIPTION OF THE INVENTION

The following is a description of the preferred embodiments of the present invention in which an electron gun is used for a monochrome cathode ray tube, with reference to the accompanying drawings.

Figure 1:
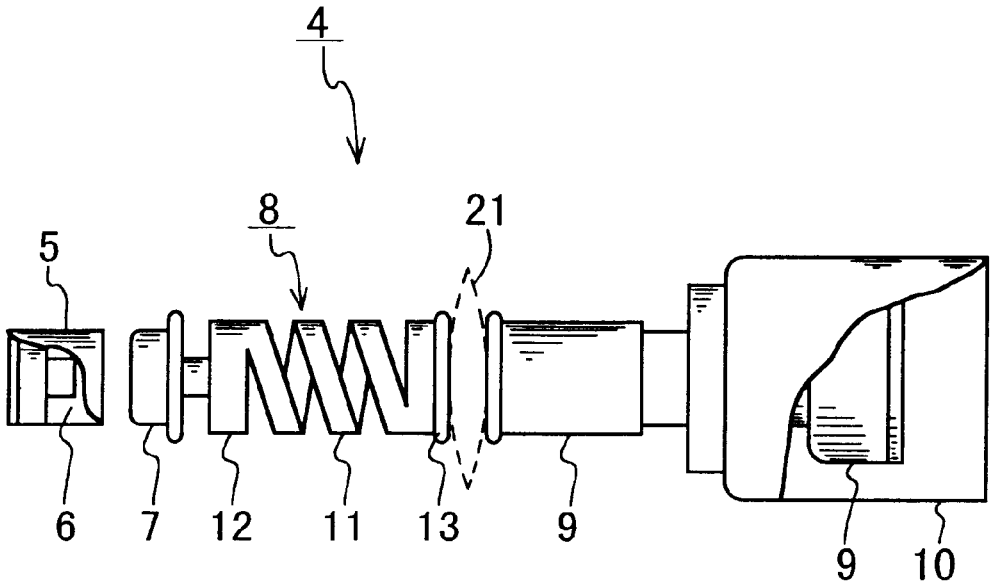
FIG. 1 is a partially broken side view to show an electron gun in accordance with an embodiment of the present invention.

FIG. 1 is a side view of an electron gun in accordance with an embodiment of the present invention. An electron gun 4 is formed by sequentially arranging a cup-shaped Gi electrode (control electrode) 5 housing a cathode 6, a cup-shaped G2 electrode (acceleration electrode) 7 facing backward to the bottom of the G1 electrode 5, a tubular G3 electrode (pre-anodic electrode) 8 disposed at a predetermined spacing to the opening of the G2 electrode 7, a G4 electrode (focusing electrode) 9 for forming a main electron lens 21 in the space to the G3 electrode 8, and a G5 electrode (anodic electrode) 10 enveloping the top end portion of the G4 electrode 9. Another electron lens will be formed in the internal of the G5 electrode 10 at a position between the G5 electrode 10 and the G4 electrode 9.

The G3 electrode 8 has an equipotential space inside thereof, and a coiled portion 11 is provided to one part of the G3 electrode 8. A plate electrode 13 is provided to the coiled portion 11 at the end portion facing the G4 electrode 9 in order to form an electron lens, while the other end portion is connected with the end portion 12 facing the G2 electrode 7. The coiled portion 11 is preferably located at the position where the velocity modulation coil is attached in view of penetrating the velocity modulation magnetic field. Therefore, the G4 electrode 9 can be partially coiled in an alternative method. However, it is further preferable to form a coiled portion 11 at the G3 electrode 8 rather than the G4 electrode 9, since the G3 electrode 8 is effective in velocity modulation because the velocity of the electron beams is low in the G3 electrode 8.

A wire made of an electrode material is formed into a coiled portion 11 and welded to the end portion 12 and to the plate electrode 13. Alternatively, the G3 electrode 8 is formed integrally by a deep-drawing, partially cut in a spiral shape, and stretched in the longitudinal direction (axial direction) to form integrally the end portion 12, the coiled portion 11, and the plate electrode 13. This allows the coiled portion 11 to be formed easily.

Figure 2:
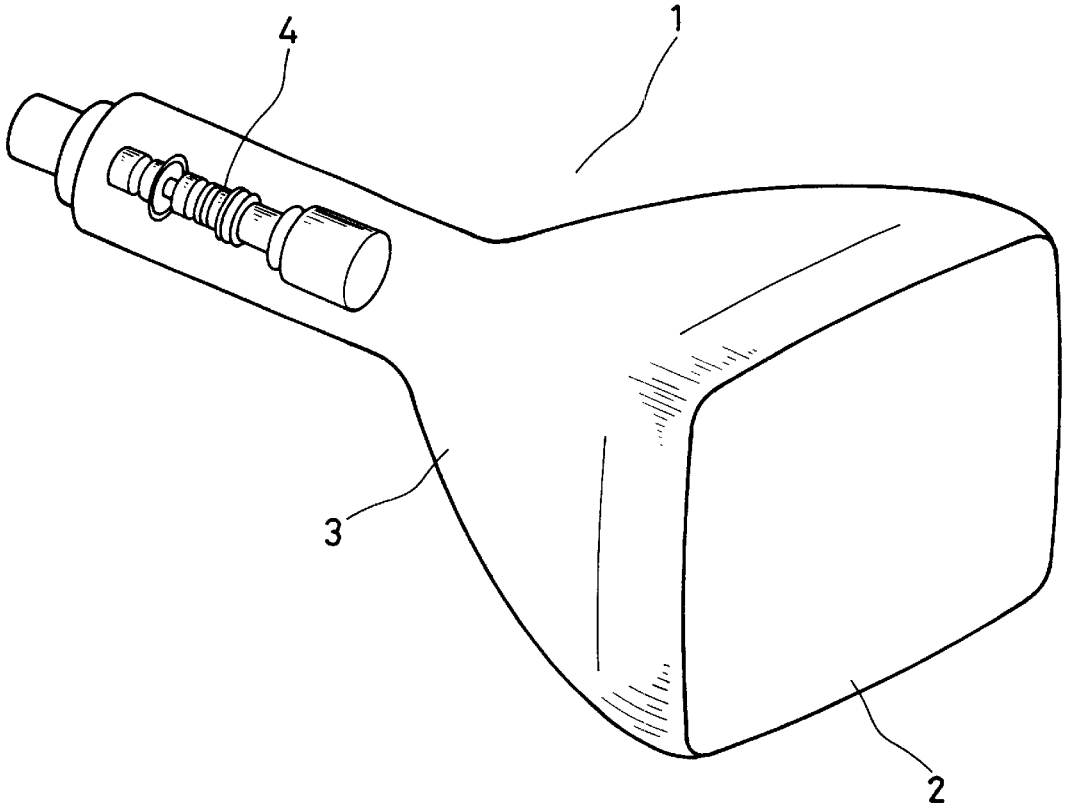
FIG. 2 is a perspective view of a cathode ray tube in accordance with an embodiment of the present invention.

As shown in FIG. 2, the electron gun 4 is integrated in the neck portion of an envelope including a face plate 2 and a funnel 3 to compose a cathode ray tube 1.

In a preferable embodiment described below, the present invention is applied to a monochrome cathode ray tube for a projection-type tube that is sized to be 16cm (7 inches), and the neck tube diameter $\phi$ is 29.1 mm. The coiled portion 11 is made of a stainless wire 0.8 mm in diameter. The length is 8.6 mm, the inner diameter is 10.4 mm, and the pitch is 1.6 mm.

The spacing between the adjacent wire parts of the coiled portion 11 is preferably 0 to 2.5 mm. Even if the adjacent wire parts are contacted with each other when the spacing is 0 mm, sufficient effects in transmitting modulation magnetic field can be obtained when compared to a case in which there is no joint, e.g., a simple deep-drawn plate. However, slight clearance is preferably provided between the adjacent wire parts to obtain a better modulation effect. When a spacing between adjacent wire parts exceeds 2.5 mm, influence of the exterior electric field is increased.

The coiled portion 11 can be made from a nonmetal material, such as a conductive ceramic or a sintered material of a mixture of carbon graphite and a binder.

An applicable conductive ceramic includes, for example, TiC or TiN as a main component to which a metal such as Co, Ni or Mo is mixed, or including an element such as Cu, Sr and $ReO_3$. When such a conductive ceramic is used for the coiled portion 11, raw material is shaped to be a pipe before being cut to be a coil or the raw material is directly coiled, and then sintered.

Figure 3:
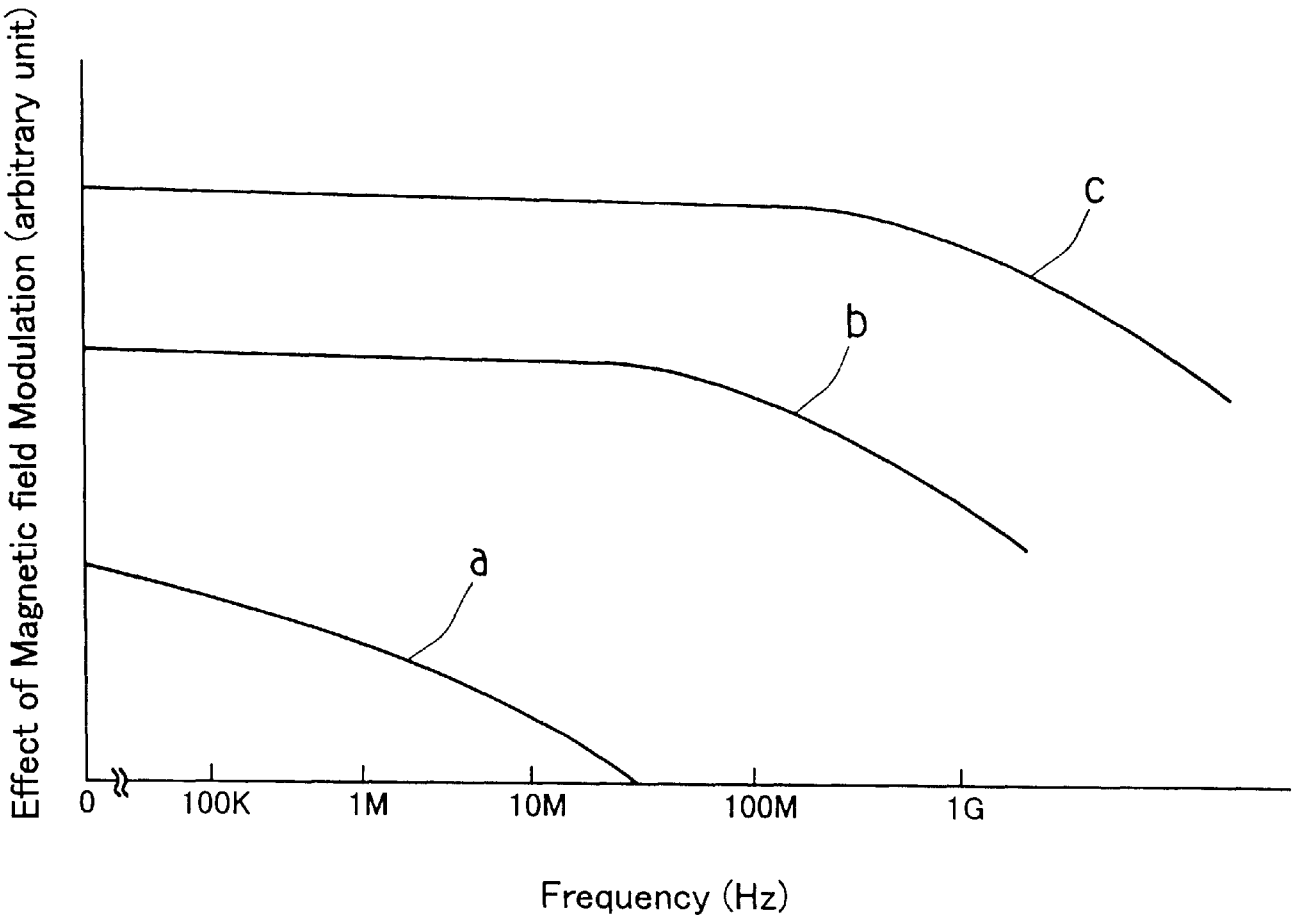
FIG. 3 is a graph to indicate the magnetic field modulation effect of an embodiment of the present invention.

FIG. 3 is a graph showing an effect of the present invention, indicating the relationship between the frequency of the magnetic field modulation and the effect of the magnetic field modulation. The measurement was carried out in case picture signals of rectangular shape for displaying vertical stripes on the phosphorous screen are supplied to the picture tube. The "effect of magnetic field modulation" indicates how much the width of the vertical lines on the phosphorous screen varies (arbitrary unit) between conditions with and without the velocity modulation. Higher value indicates the better effect for the magnetic field modulation. In FIG. 3, the curve (a) indicates a conventional electron gun without a coiled portion, the curve (b) indicates an electron gun of the present invention having a coiled portion of a metal material, and curve (c) indicates an electron gun of the present invention having a coiled portion of a conductive ceramic. As shown in FIG. 3, electron guns of the present invention can provide a greater magnetic field modulation effect than the conventional gun over a wide range of frequencies. It is also known from FIG. 3 that a coiled portion made of a conductive ceramic can provide a better magnetic field modulation effect than a coiled portion made of a metal material.

Figure 4:
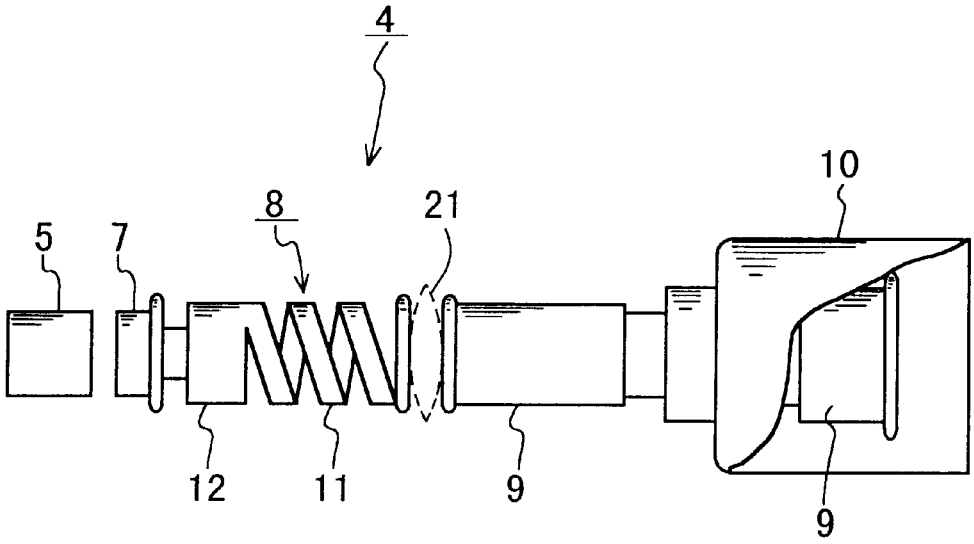
FIG. 4 is partially broken side view to show an electron gun in accordance with an embodiment of the present invention.
Figure 5:
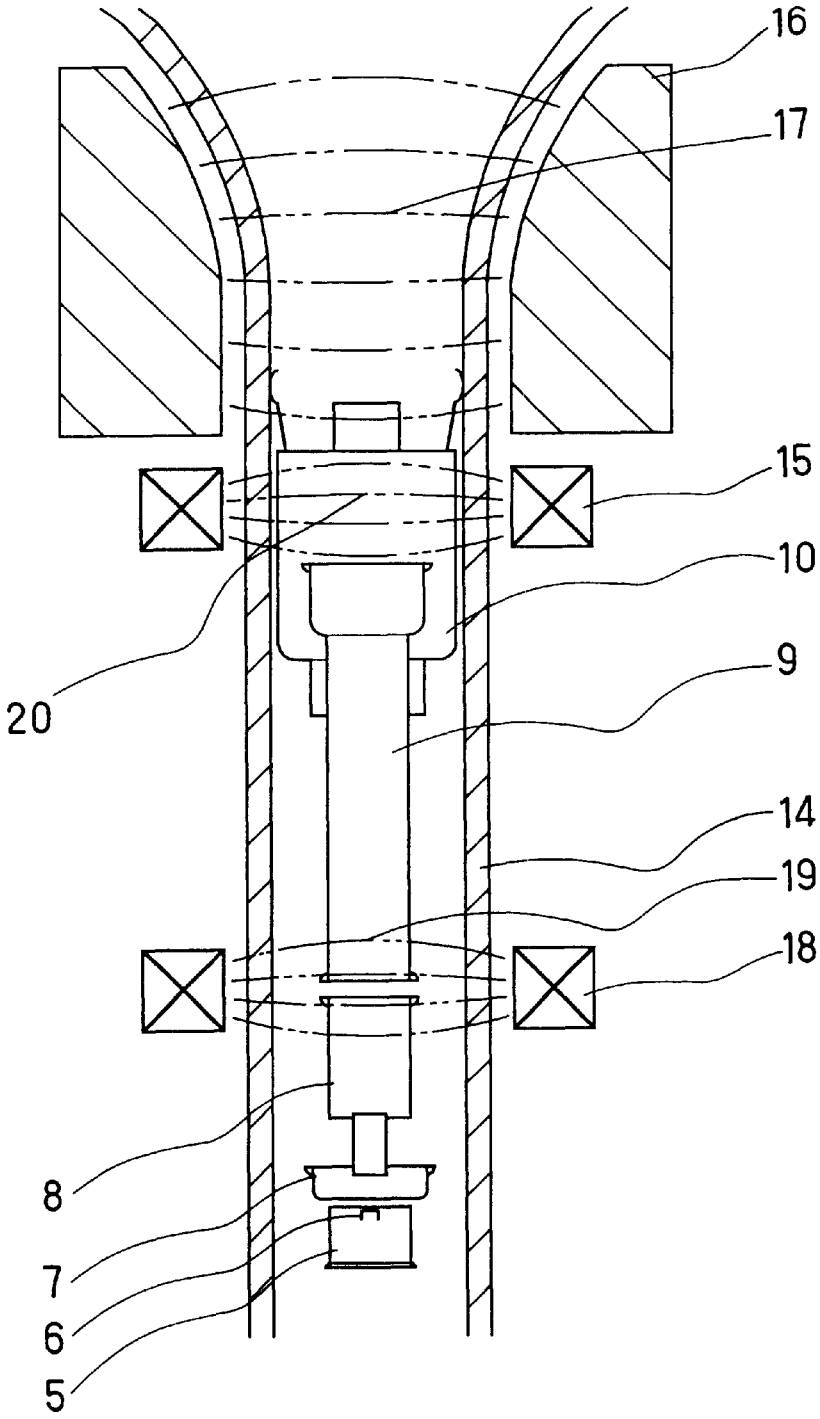
FIG . 5 PRIOR ART
FIG. 5 is an enlarged cross-sectional view to show an electron gun of a conventional cathode ray tube.
Figure 6:
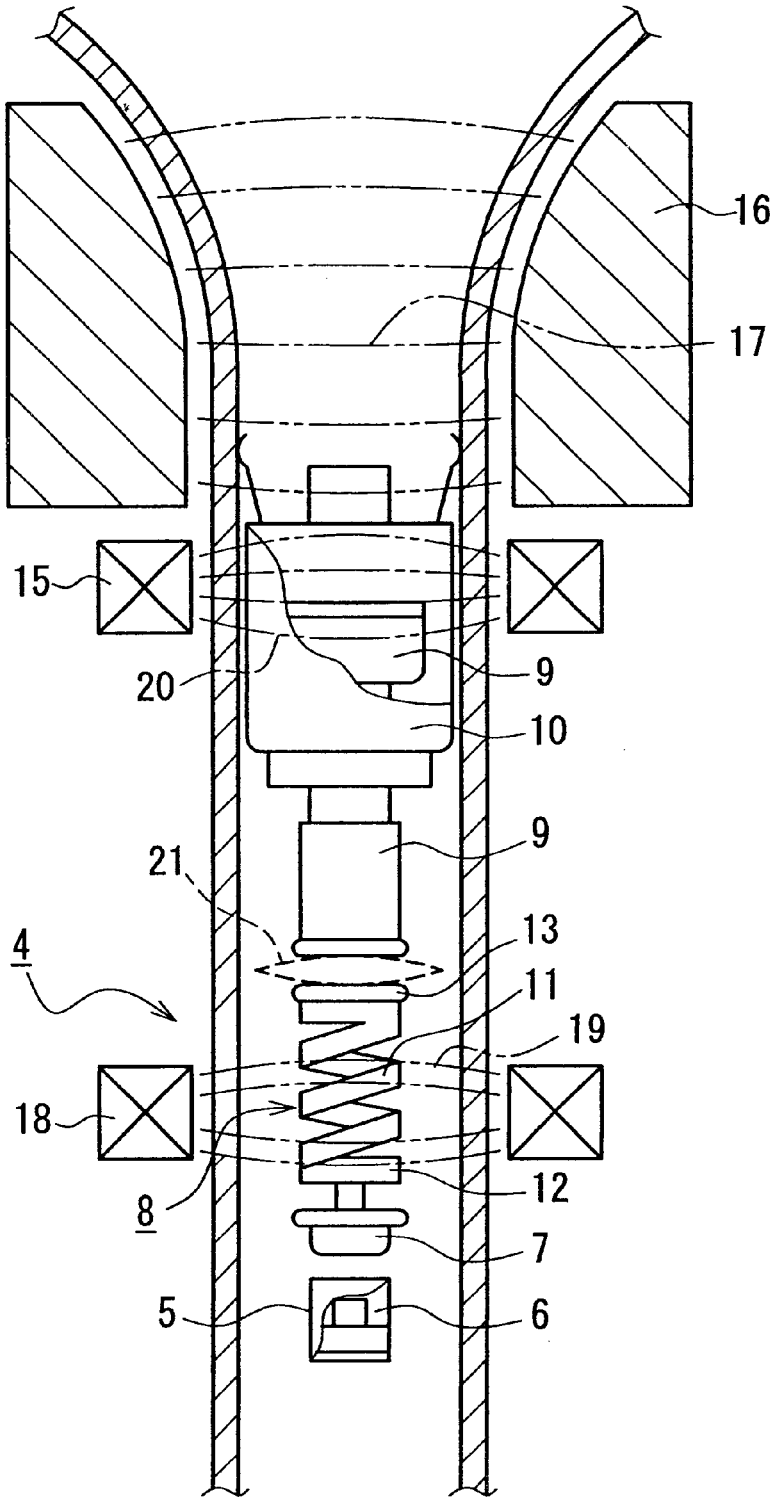
FIG. 6 is an enlarged cross-sectional view showing an electron gun in accordance with an embodiment of the present invention.

FIG. 4 is an embodiment where the present invention is applied to a G3 electrode 8 of an electron gun for a monochrome cathode ray tube, as in the case of FIG. 2. In this embodiment, no plate electrode is provided to the end portion of the coiled portion 11 facing the G4 electrode 9. The end face of the coiled portion 11 forms an electrode. Also, a main electron lens 21 is formed between the end face of the coiled portion 11 and the G4 electrode 9.

Though the present invention is applied to a monochrome cathode ray tube in the above-mentioned embodiments, it can also be used for a color cathode ray tube. In such a case, for example, a coiled portion is provided to a G3 electrode enveloping three electron beams.

The present invention can provide a cathode ray tube having an electron gun to obtain a desired electron beam modulation effect without preventing modulation magnetic field from passing from exterior of the cathode ray tube.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. An electron gun comprising a tubular electrode to pass electron beams inside the electrode, wherein at least one part of the tubular electrode is formed into a coiled portion, the coiled portion composes an outside wall of the electrode, and a main lens is formed outside the coiled portion in an axial direction of the tubular electrode.

2. The electron gun according to claim 1, wherein the coiled portion is formed in at least one part of a pre-anodic electrode.

3. The electron gun according to claim 1, wherein the coiled portion is composed of a nonmetal material.

4. The electron gun according to claim 1, wherein the coiled portion is composed of a coiled wire.

5. The electron gun according to claim 1, wherein the coiled portion is formed so that a spacing between parts of the coiled portion adjacent to each other in the axial direction is no more than 2.5 mm.

6. The electron gun according to claim 5, wherein the parts of the coiled portion are contacted with each other.

7. A cathode ray tube comprising:

an envelope, the envelope having a neck portion;

an electron gun provided inside the neck portion of the envelope; and a velocity modulation coil provided to the outside of the neck portion of the envelope;

wherein the electron gun includes a pre-anodic electrode, at least one part of which is formed into a coiled portion, and the velocity modulation coil envelopes the coiled portion; and the coiled portion has a structure of allowing a magnetic field applied from the velocity modulation coil to pass through the coiled portion to the inside of the electrode.

* * * * *